US007080474B1

(12) United States Patent
Curtiss et al.

(10) Patent No.: US 7,080,474 B1
(45) Date of Patent: Jul. 25, 2006

(54) DEVICE FOR AND METHOD OF DISPLAYING MESSAGES

(76) Inventors: Gordon H. Curtiss, 1335 Corley Ct., West Columbia, SC (US) 29070; David A. Tomlin, 5359 Chaplin's Landing, Hollywood, SC (US) 29449

( * ) Notice: Subject to any disclaimer, the term of this patent is extended or adjusted under 35 U.S.C. 154(b) by 173 days.

(21) Appl. No.: 10/728,416

(22) Filed: Dec. 8, 2003

Related U.S. Application Data

(63) Continuation-in-part of application No. 09/957,737, filed on Sep. 20, 2001, now Pat. No. 6,785,990.

(51) Int. Cl.
*G09F 21/04* (2006.01)
*G09F 7/00* (2006.01)

(52) U.S. Cl. ..... 40/463; 40/591; 40/601

(58) Field of Classification Search ..... 40/463, 40/591–593, 601, 610
See application file for complete search history.

(56) References Cited

U.S. PATENT DOCUMENTS

| | | | | | |
|---|---|---|---|---|---|
| 3,159,935 | A | * | 12/1964 | Rubens | 40/415 |
| 4,179,832 | A | * | 12/1979 | Lemelson | 40/540 |
| 4,369,591 | A | * | 1/1983 | Vicino | 40/610 |
| 5,628,133 | A | * | 5/1997 | Cooper | 40/591 |
| 5,778,581 | A | * | 7/1998 | Bailey | 40/610 |
| 5,791,077 | A | * | 8/1998 | Felber | 40/610 |
| 6,148,551 | A | * | 11/2000 | Glass | 40/214 |

FOREIGN PATENT DOCUMENTS

| | | | |
|---|---|---|---|
| JP | 2000132130 | A * | 5/2000 |
| WO | WO 00/31716 | A1 * | 6/2000 |

* cited by examiner

*Primary Examiner*—Cassandra Davis
(74) *Attorney, Agent, or Firm*—John D. Gugliotta; P. Jeff Martin

(57) ABSTRACT

A message display device is provided which includes a portable control unit having electric power supplied externally. A timing device is provided which controls opening and closing of a hinged member, for example a car hood. The hinged member is attached with a visual display. A lifting device elevates the hinged member away from a lower surface to stretchably reveal display.

14 Claims, 8 Drawing Sheets

DEVICE FOR AND METHOD OF DISPLAYING MESSAGES

RELATED APPLICATIONS

The present invention is a Continuation in Part of Ser. No. 09/957,737, filed on Sep. 20, 2001.

BACKGROUND OF THE INVENTION

1. Field of the Invention

The present invention relates generally to a device for and method of displaying messages such as advertising information. The device comprises means for opening and closing a hinged member, such as the hood of a car, means of attaching the message to such hinged member and means of controlling the timing of the opening an closing of such hinged member, either through prior programming or through sensing of an event, such as a person walking past a car to the hood of which is attached the device. The method of displaying messages utili8zes the device or similar devices to open and close hinged members in such manner as to catch the eye of those persons passing by the location where the devices are located thus drawing attention to the messages displayed thereby.

2. Description of the Related Art

There are known in the art many forms of message displays and eye catching devices which help ensure that persons passing by a location will see and take note of messages being displayed. Neon lights or search lights draw attention to a location and the messages, typically advertising, the proprietor wishes to impart. During all hours of the day banners and fixed signs impart the messages. Typically, it is movement which most attracts the human eye and thus incorporation of movement into displays helps assure that the message is received by even casual passers by. Large flags and strings of small, often triangular, flags attract attention as they blow in the breeze. Balloons over establishments also catch the eye both with movement and with the reaction of the viewer to a large object in what is normally clear air. Flashing lights can attract attention at all hours. Each of these devices and methods performs the intended function well enough, but such devices and methods are so common place that their effectiveness is diminished.

SUMMARY OF THE INVENTION

It is the object of the present invention to provide a device which allows messages to be displayed with movement through the opening and closing of a hinged member, such as a car hood. Such device shall cause the hinged member to open either at pre-programmed times or upon the happening of an event. As an example, the device could be set to open when the presence of a person is sensed in the vicinity of a device. A person viewing a given car at a car lot will walk up to that car. The device, sensing the person's presence then opens the hood of the car, revealing the message. Thus single displays can be provided at various places on any merchant's location, not just car lots, and such individual displays are opened by the device to impart the message to prospective customers as they walk by those particular locations. The random opening and closing of the displays resulting from this action will catch the attention of those walking or driving by the merchant's location, thus creating more interest in visiting such merchant's location, thus creating more interest in visiting such merchant's location. In the alternative the devices can be programmed to open and close at pre-set times. As an example, on a car lot, a row of cars could be made to open sequentially to impart a message word by word, phrase by phrase, or letter by letter, from hood to hood. Again the resulting movement will attract attention from those walking or passing by the merchant's location, creating interest in visiting such merchant. It is further an object of this invention to provide a method of displaying messages in this manner using the device or similar devices.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
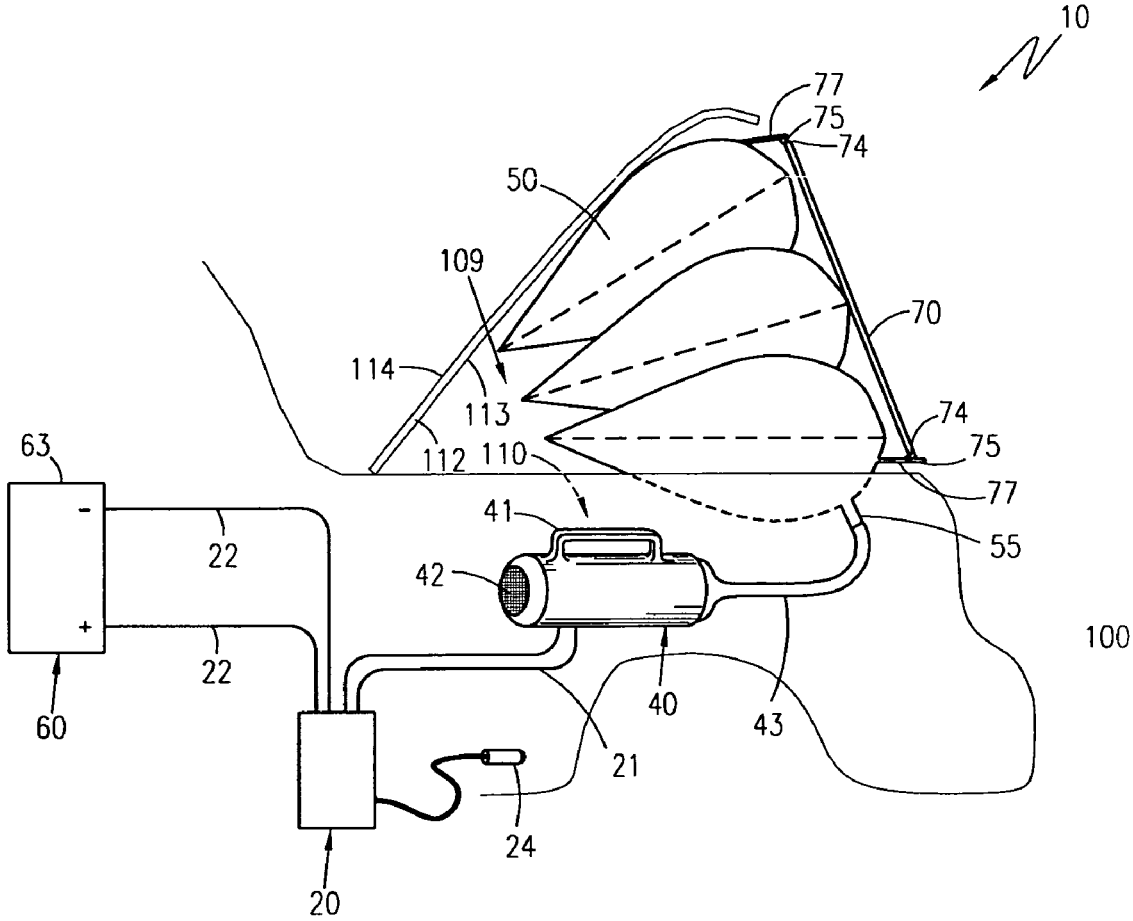
FIG. 1 is a perspective view of a message display device, according to the preferred embodiment of the present invention.
Figure 2:
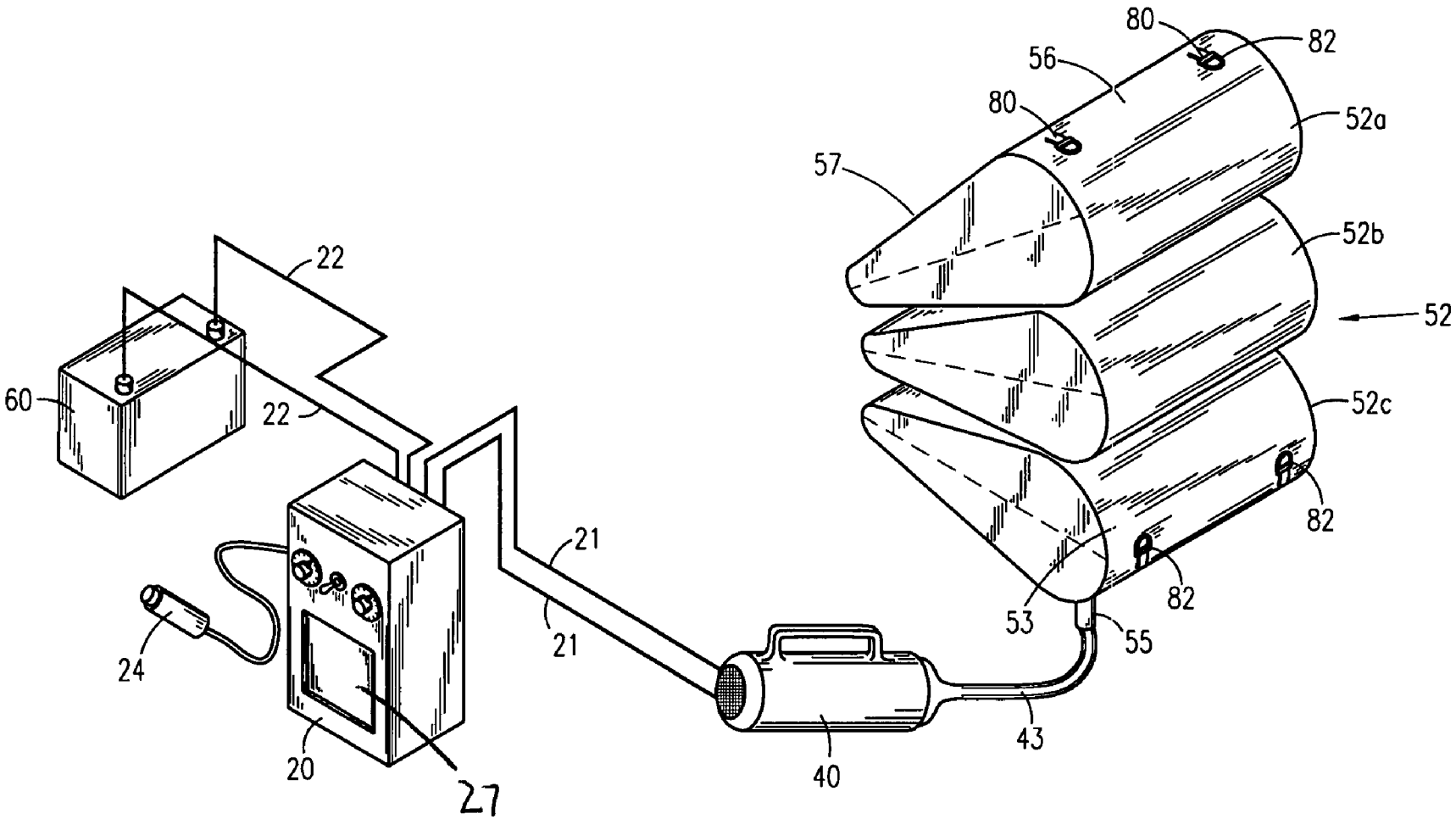
FIG. 2 is an isometric view of the message display device, according to the preferred embodiment of the present invention.
Figure 3:
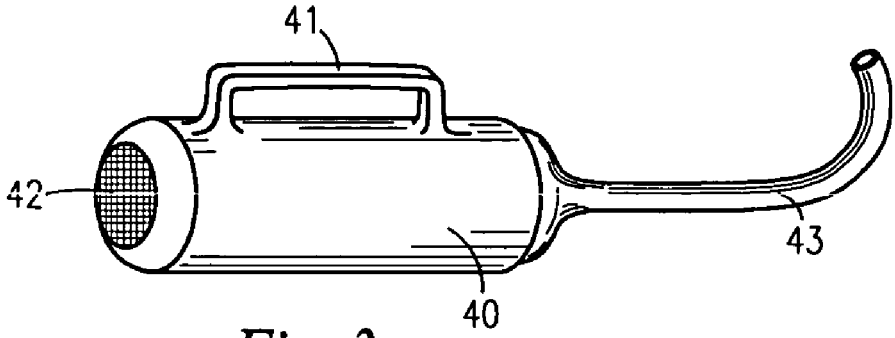
FIG. 3 is a perspective view of the air blower, according to the preferred embodiment of the present invention.
Figure 4:
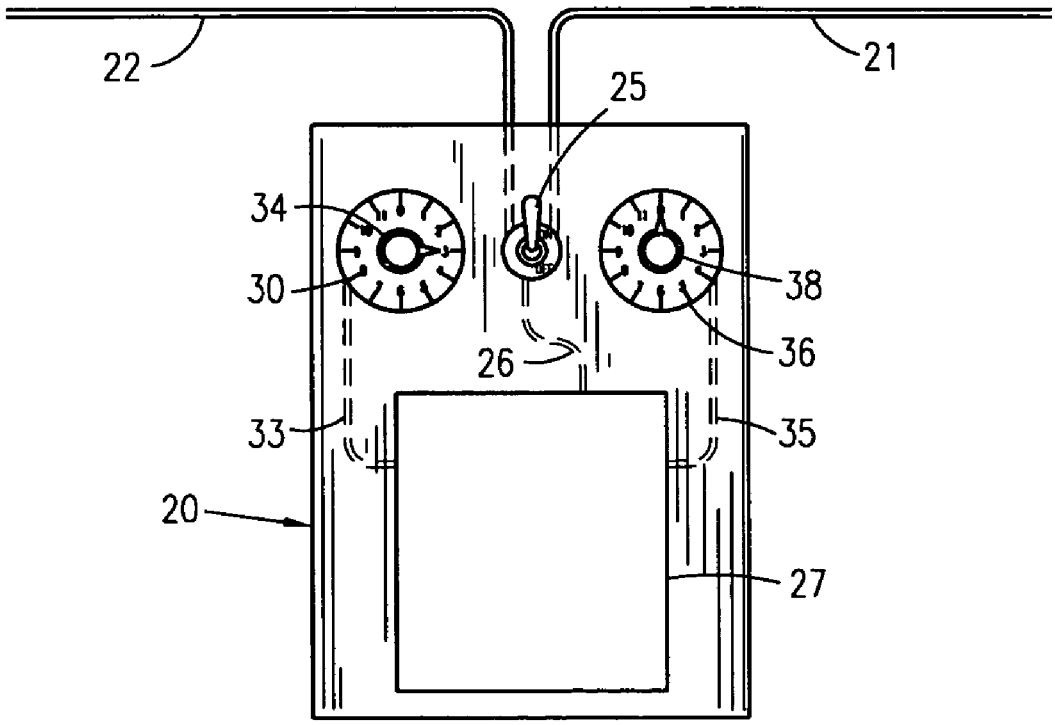
FIG. 4 is a partial sectional view of the potentiometric control unit, according to the preferred embodiment of the present invention.
Figure 5:
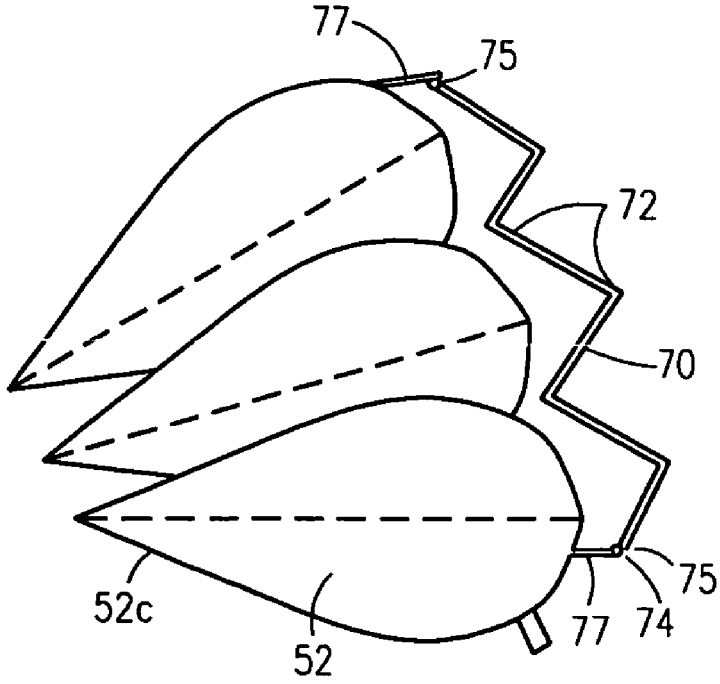
FIG. 5 is a side elevational view of the plurality of inflatable air bags with visual display shown attached thereto in a semi-compressed state, according to the preferred embodiment of the present invention.

Referring now to FIGS. 1–4, a message display device 10 is shown, according to the present invention, comprised of a compact, potentiometric control unit 20 being electrically connected to an air blower 40 via controlled connecting circuit 21. The potentiometric control unit 20 is of a size allowing for placement within an engine compartment 110 of a vehicle 100 if desired. The air blower 40 includes a handle 41 to facilitate portability, and an air vent 42 provided along a rear side thereof, the function of which to be described in greater detail below. The control unit 20 is powered via a 12-volt power source 60 to which control unit 20 is electrically connected. It is envisioned that control unit 20 is connected electrically to a 12-volt battery 63 via power cord 22 having battery terminal connecting clamps. Alternatively, it is envisioned that control unit 20 is supplied with a cigarette lighter adapter 24 to facilitate electrical connection to power source 60.

An air hose 43 extends from air blower 40 and connects to a visual display lifting apparatus 50, to be described in greater detail below.

The control unit 20 is comprised of an electronic cycle timing device 27 connected electrically between power source 60 via power cord 22 and air blower 40 via controlled connecting circuit 21. An ON/OFF switch 25 electrically controls electronic cycle timing device 27 via controlled circuit cord 26.

The control unit 20 further comprises a first adjustable potentiometer 30 being electrically connected to electronic cycle timing device 27 via connecting wire 33. The first adjustable potentiometer 30 is provided with an adjustable knob and pointer 34, wherein first adjustable potentiometer 30 is adapted to operate in communication with electronic cycle timing device 27 to allow for manually selected, active current flow for operative engagement over a selectively prescribed time interval.

A second adjustable potentiometer 36 is electrically connected to electronic cycle timing device 27 via connecting wire 35. The second adjustable potentiometer 36 is provided with an adjustable knob and pointer 38, wherein second adjustable potentiometer 36 is adapted to operate in communication with electronic cycle timing device 27 to control air bag deflation duration.

Referring now to FIGS. 1–6, the visual display lifting apparatus 50 defines a plurality of inflatable air bags 52 which includes an upper, medial, and lower air bag 52*a*, 52*b*, 52*c* respectively. Each of the plurality of inflatable air bags 52 is generally triangular-shaped in cross-section, and has a lower surface and an upper surface joined by a convoluted circumferential sidewall 53. The plurality of inflatable air bags 52 is fabricated of a textile material defining a non-skid surface having small protuberances 56 randomly dispersed. The protuberances 56 facilitate adhesive engagement to an upper surface 112, here shown as a fabric layer 113 adhered to a bottom surface of a vehicle hood 114, and a lower surface 109, here shown as the automobile engine compartment 110. The textile material is envisioned as vinyl 57. The upper surface of the lower air bag 52*c* is attached in an air-tight manner to the lower surface of the medial air bag 52*b*, and the upper surface of medial air bag 52*b* is attached in an air-tight manner to the lower surface of the upper air bag 52*a*. The upper surface of the lower air bag 52*c*, and the lower surface of both the medial air bag 52*b* and upper air bag 52*a* define one or more air-flow portals to facilitate air communication between the plurality of inflatable air bags 52.

In order to facilitate removable attachment of a visual display 70 to the visual display lifting apparatus 50, fastening means 80, shown herein as integral strap-support loops 82 are positioned along a left and right front corner of upper air bag 52*a* and along a left and right front corner of lower air bag 52*c*. The visual display 70 defines a generally square-shaped sheet of collapsible material having an upper edge opposing a lower edge. The visual display 70 is provided with a plurality of linear creases 72 being horizontally aligned at spaced locations theredown, the function of which to be described in greater detail below. The upper edge and lower edge of the visual display 70 is formed into an elongated loop 74 which provides a passage through which a straightener member 75 is slidably inserted. The straightener member 75 is of a length measuring greater than a length of the elongated loop 74, thus upon insertion of straightener member 75 therethrough, opposed ends of straightener member 75 protrude beyond ends of elongated loop 74.

A fastening strap 77 is looped around opposed ends of straightener member 75 and inserted within the strap-support loops 82, whereupon each fastening strap 77 is subsequently tied, thereby facilitating attachment of visual display 70 to visual display lifting apparatus 50. The straightener member 75 serves to provide a visual display 70 being taut during periods of exhibition.

Figure 6:
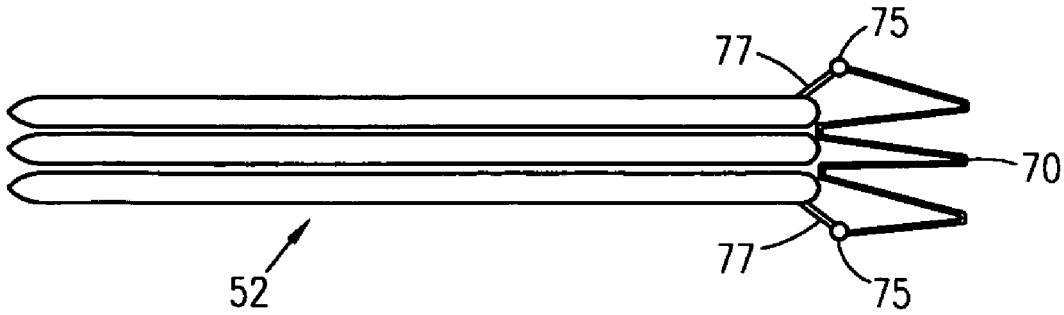
FIG. 6 is a side elevational view of the plurality of inflatable air bags with visual display shown attached thereto in a compressed state, according to the preferred embodiment of the present invention.

In operation of the message display device 10, upon setting first adjustable potentiometer 30 to a desired setting, current passes from electronic cycle timing device 27 to air blower 40, wherein air blower 40 is actuated to supply pressurized air to the plurality of inflatable air bags 52 via air hose 43, and more specifically, pressurized air is supplied by air blower 40 via air hose 43 to lower air bag 52*c* through an air inlet port 55 thereof, thus inflating lower air bag 52*c*. Being in air communication with lower air bag 52*c*, the medial air bag 52*b* and upper air bag 52*a* are inflated over the prescribed duration, thus applying a simultaneous upward force against the upper surface and a downward force against the lower surface, thereby causing an opening of the upper surface and facilitating elongated extension of the visual display 70 in a taut manner. Upon completion of the selected cycle time interval as set by first adjustable potentiometer 30, the plurality of inflatable air bags 52 deflate, discharging air therefrom through air hose 43 to air blower 40 from which air escapes via air vent 42 thereof for a time period as prescribed by the second adjustable potentiometer 36. As the plurality of inflatable air bags 52 deflate, the plurality of linear creases 72 of the visual display 70 mate with recesses formed by the convoluted circumferential sidewalls 53 of air bags 52. Thus upon deflation, the air bags 52 and visual display 70 collapse in an accordion manner to a compact shape as shown in FIG. 6.

Figure 7:
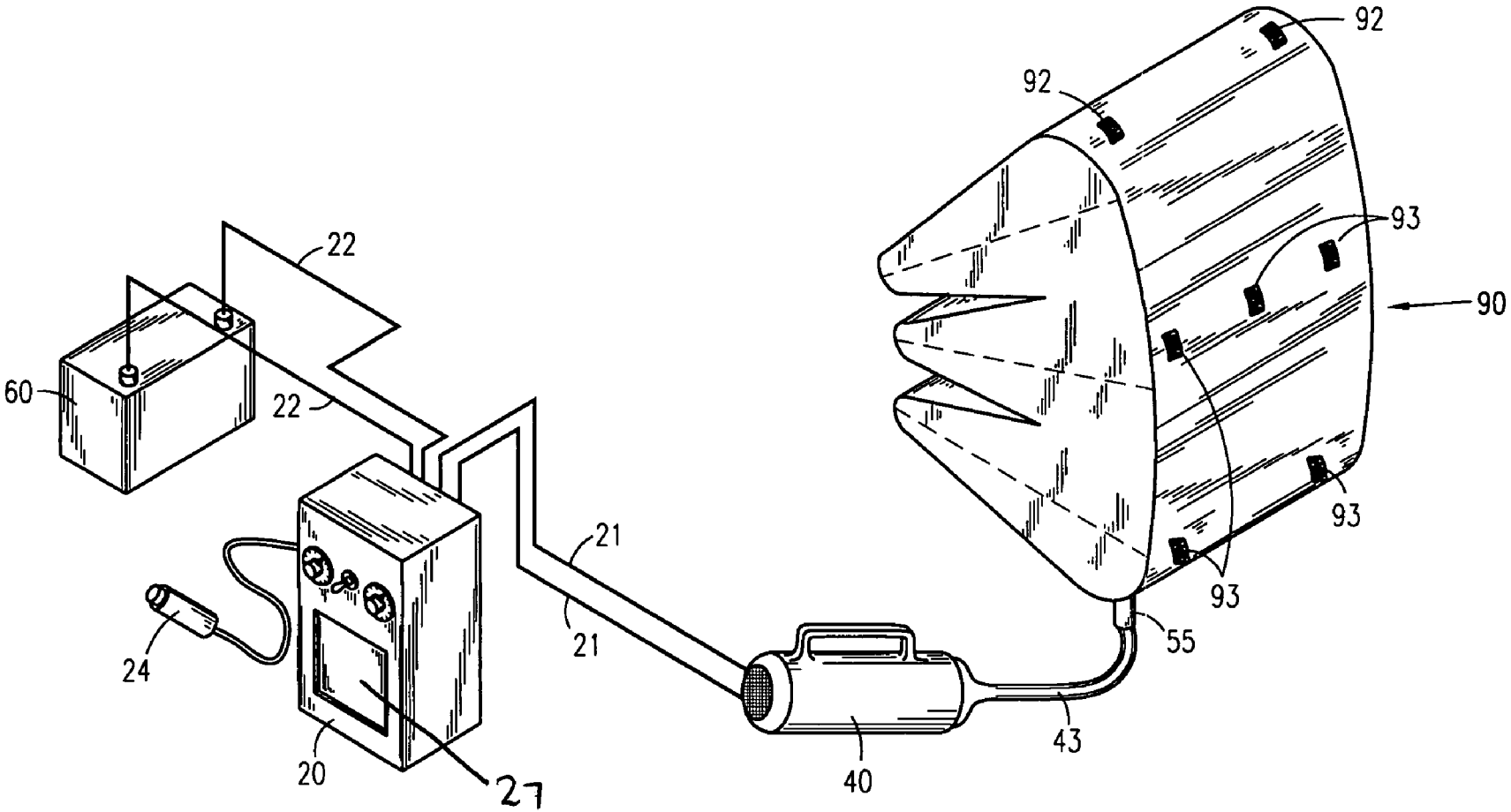
FIG. 7 is an isometric view of a first alternate visual display lifting apparatus.
Figure 8:
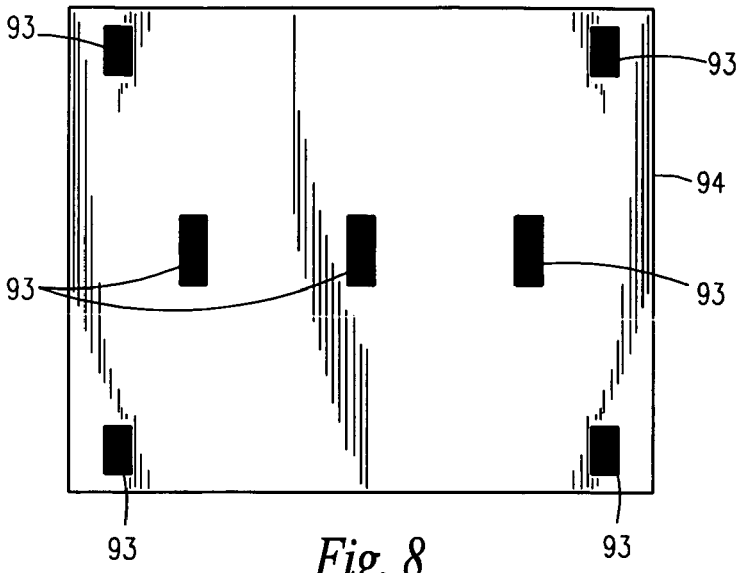
FIG. 8 illustrates corresponding hook-and-loop fastener elements shown attached to a rear side of a selected message display sheet.
Figure 9:
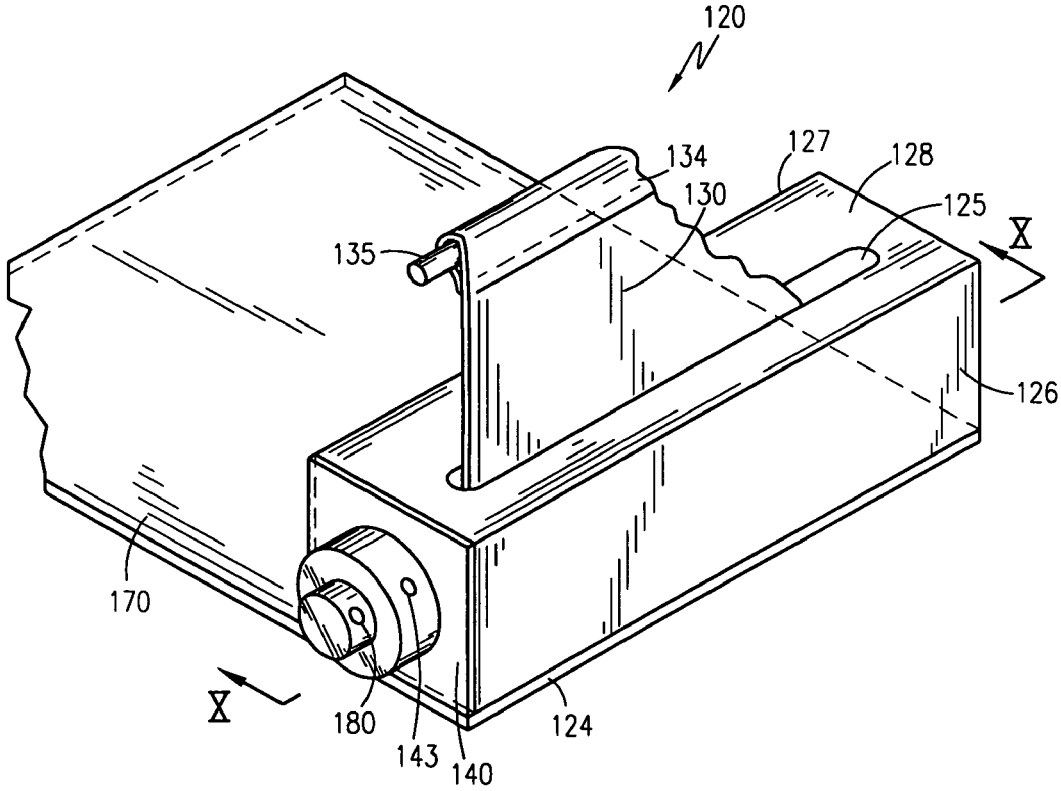
FIG. 9 illustrates a perspective view for an alternate embodiment for the visual display, shown as a retractable visual display.
Figure 10:
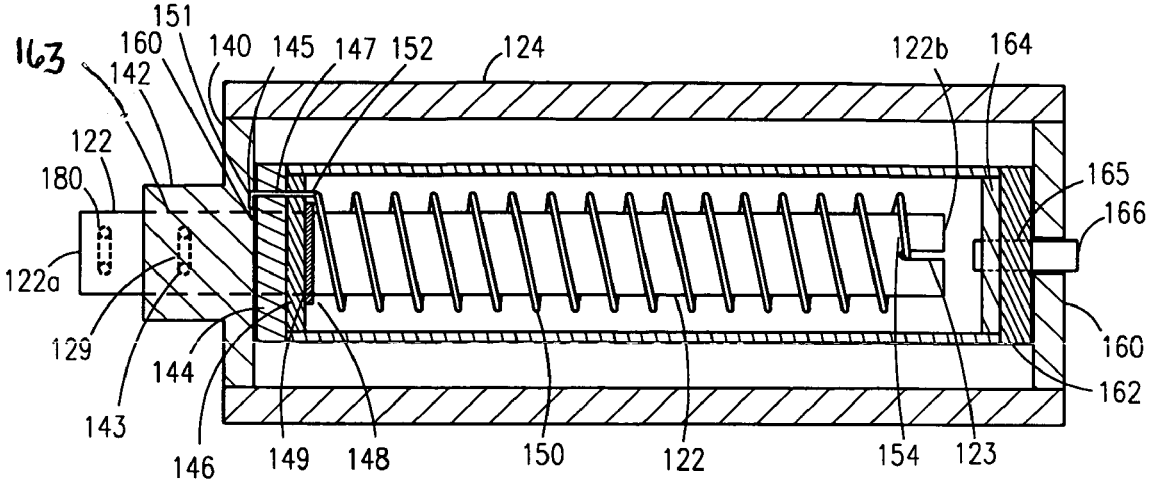
FIG. 10 is a cross-sectional view of the retractable visual display taken along lines X—X of FIG. 9.
Figure 11:
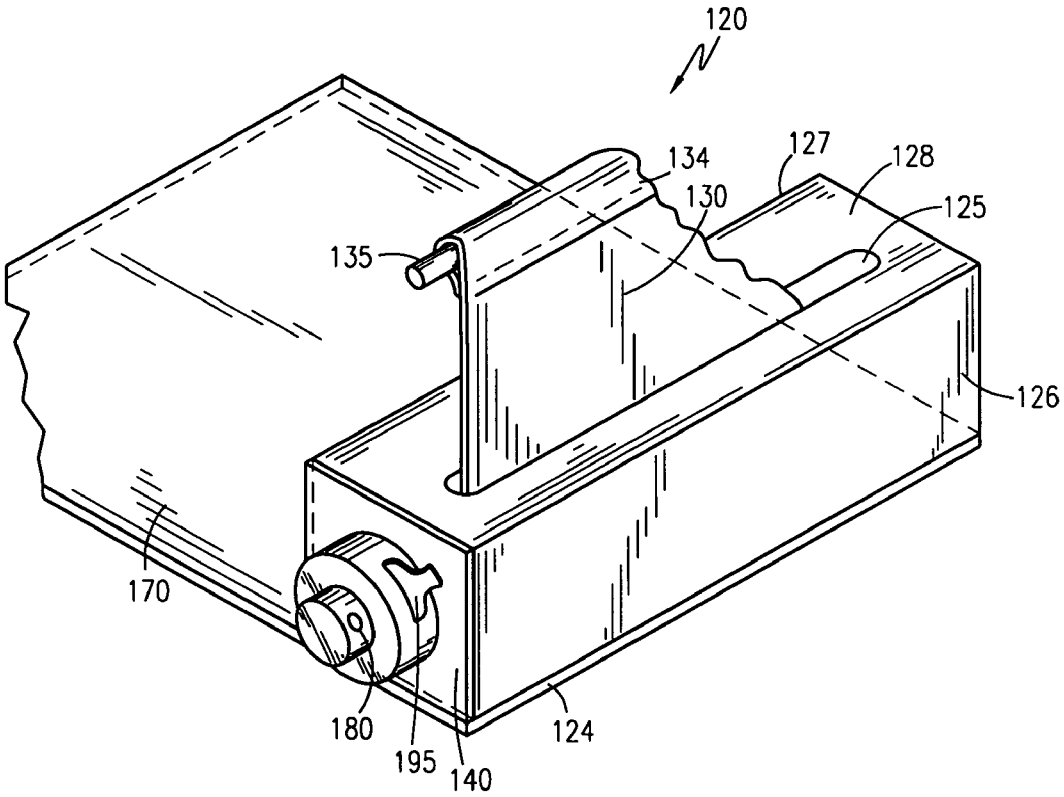
FIG. 11 is a perspective view of the retractable visual display illustrating insertion of the industrial pin through the cylindrical boss of header plate.
Figure 12:
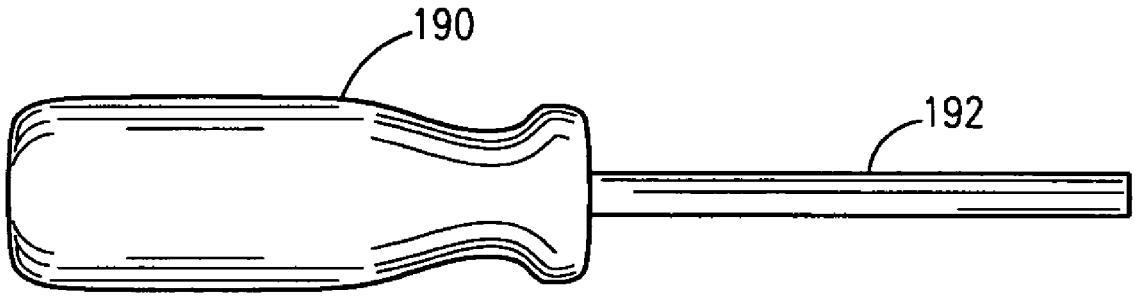
FIG. 12 is a side elevational view of the tensioner tool.

Referring now to FIGS. 7–8, it is envisioned that an alternative visual display lifting apparatus 90, of an inflatable configuration, is adapted to accommodate interchangeable message displays. The visual display lifting apparatus 90 defines a forward sidewall having a plurality of fastener elements 92, shown herein as hook-and-loop fasteners 93, attached thereto, adapted to mate with corresponding hook-and-loop fastener elements 93 attached to a rear side of a selected message display sheet 94, thus allowing for a myriad of interchangeable messages to be easily and quickly displayed and changed upon desire.

Referring now to FIGS. 9–12, an alternate embodiment for the visual display 70 is described hereinbelow, shown as a retractable visual display 120. The retractable visual display 120 comprises a generally rectangular housing 124 containing a spring-biased mandrel 122, around which a flexible banner 130 is wound and affixed at a lower end thereof. The housing 124 includes an elongated slot 125 located along a top side 128 and adjacent to a forward side wall 126 of housing 124 so as to permit banner 130 to pass therethrough. The forward side wall 126 is opposed by a rear side wall 127.

A header plate 140, having an integral cylindrical boss 142 projecting outwardly therefrom, provides bearing support to mandrel 122. The header plate 140 is mounted flush to an outer end of housing 124 against the forward side wall 126, the top side 128, and the rear side wall 127.

Mounted against an inner wall of header plate 140, a torque-spring anchoring cap 144 is provided with an internal elongated notch 145 for anchoring a first end 151 of a torque spring 150. Mounted flush against and having a smaller diameter than torque-spring anchoring cap 144, a cap ring 146 is provided. The cap ring 146 defines a spring-arm passage 147 extending downward therethrough and being aligned with notch 145 of torque-spring anchoring cap 144. The spring-arm passage 147 provides a channel through which an arm 152 of torque spring 150 passes and extends therefrom at its first end 151 to the notch 145 of torque-spring anchoring cap 144.

In order to limit lateral movement of mandrel 122 toward header plate 140, a mandrel-abutment ring 148 is provided. The mandrel-abutment ring 148 is formed integral to mandrel 122 and extends radially therearound. A face 149 of mandrel-abutment ring 148 abuts against an outer face of cap ring 146 upon lateral movement of mandrel 122 in a direction toward cap ring 146, thus arresting further movement of mandrel 122.

The mandrel 122 includes an anterior end 122*a* opposite a posterior end 122*b*, wherein mandrel 122 rotatably resides within a mandrel-receiving chamber 160 inside housing 124. The mandrel-receiving chamber 160 is formed as a cylindrical cavity 163 which extends through cap ring 146, torque-spring anchoring cap 144, and header plate 140. The anterior end 122*b* of mandrel 122 protrudes outside header plate 140. The mandrel 122 is adapted to provide return torsional force via the torque spring 150 being coiled therearound down a length thereof, and attached to mandrel 122 at ends 122*a*, 122*b* thereof.

The posterior end 122*b* of mandrel 122 is provided with an elongated slit 123 extending axially therethrough which allows anchored engagement by an elbow 154 of torque spring 150, thus securing torque spring 150 to mandrel 122.

An end cap plate 160 is mounted to housing 124 against the forward side wall 126, top side 128, and rear side wall 127, positioned opposed to header plate 140. A bearing cap 162 is mounted against an inner wall of end cap plate 160. Mounted flush against and having a smaller diameter than bearing cap 162, a core end cap 164 is provided. A linearly elongated bore 165, which extends through end cap plate 160, bearing cap 162, and core end cap 164, provides a bearing surface for a bearing pin 166.

In order to facilitate manual torquing of the mandrel 122, the anterior end 122*a* thereof is provided with an elongated slot 180 extending axially therethrough. The elongated slot 180 is adapted to receive a flat working end 192 of a standard flat-blade screwdriver 190.

In order to facilitate locking of a desired torque of the mandrel 122, both the cylindrical boss 142 of header plate 140 and the mandrel 122 are each provided with a threaded thru-hole 143, 129 respectively, which are aligned and threadedly receive a threaded industrial pin 195 or machine screw.

The retractable visual display 120 is mounted atop a front portion of an elongated lifting apparatus support base 170, while a remaining portion thereof provides a support surface for accommodating the visual display lifting apparatus 50.

The flexible banner 130 of the retractable visual display 120 has an upper edge formed into an elongated loop 134 which encases a straightener member 135. The straightener member 135 is of a length measuring greater than a length of elongated slot 125 of housing 124, thereby preventing retraction of straightener member 135 into housing 124.

In order to facilitate removable attachment of flexible banner 130 to the elevating device 50, ends of the straightener member 135 are inserted through the integral strap-support loops 82 of upper air bag 52*a*.

2. Operation of the Preferred Embodiment

In accordance with the preferred embodiment of the present invention the message display device 10 is used in the following manner. User first places the visual display lifting apparatus 50 atop a lower surface 109. User loops fastening strap 77 around opposed ends of straightener member 75 and inserts such ends within the strap-supported loops 82, whereupon each fastening strap 77 is subsequently tied, thereby facilitating attachment of visual display 70 to visual display lifting apparatus 50. User next electrically connects control unit 20 to a 12-volt battery 63 via power cord 22. User sets first adjustable potentiometer 30 to a desired setting, thus actuating air blower 40 to supply pressurized air to the plurality of inflatable air bags 52, thereby causing an opening of the upper surface 112, and facilitating elongated extension of the visual display 70 in a taut manner. Upon completion of the selected cycle time interval as set by first adjustable potentiometer 30, the plurality of inflatable air bags 52 deflate, discharging air therefrom through air hose 43 to air blower 40 from which air escapes via air vent 42 thereof for a time period set by user via the second adjustable potentiometer 36. As the plurality of inflatable air bags 52 deflate, the plurality of linear creases 72 of the visual display 70 mate with recesses formed by the convoluted circumferential sidewalls 53 of air bags 52. Thus upon deflation, the air bags 52 and visual display 70 collapse in an accordion manner to a compact shape.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A message display device comprising:

a potentiometric control unit, said potentiometric control unit is electrically connected to an air blower via controlled connecting circuit, said potentiometric control unit is of a compact size allowing for placement within an engine compartment of a vehicle, wherein said potentiometric control unit is connected electrically to a power source via a power cord, wherein said power cord has battery terminal connecting clamps to facilitate attachment to said power source;

said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower; and a visual display, said visual display is removably attached to said visual display lifting apparatus via a fastening means.

2. The message display device of claim 1, wherein said visual display lifting apparatus is of an inflatable configuration, said visual display lifting apparatus defines a forward sidewall having a plurality of fastener elements attached to said forward sidewall thus said visual display lifting apparatus allows for a myriad of interchangeable messages to be easily and quickly displayed, changed and removably attached thereto upon desire.

3. The message display device of claim 2, wherein said fastener elements are hook-and-loop fasteners.

4. A message display device comprising:

a potentiometric control unit, said potentiometric control unit is electrically connected to an air blower via controlled connecting circuit, said potentiometric control unit is of a compact size allowing for placement within an engine compartment of a vehicle, a power source, said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower; and a visual display, said visual display is removably attached to said visual display lifting apparatus via a fastening means;

wherein said potentiometric control unit comprises:

an electronic cycle timing device, said electronic cycle timing device is connected electrically between said power source via power cord and said air blower via a controlled connecting circuit;

an ON/OFF switch, said ON/OFF switch electrically controls said electronic cycle timing device via a controlled circuit cord;

a first adjustable potentiometer, said first adjustable potentiometer is electrically connected to said electronic cycle timing device via a first connecting wire, said first adjustable potentiometer is provided with an adjustable knob and pointer, wherein said first adjustable potentiometer is adapted to operate in communication with said electronic cycle timing device to allow for manually selected, active current flow for operative engagement over a selectively prescribed time interval; and a second adjustable potentiometer, said second adjustable potentiometer is electrically connected to said electronic cycle timing device via a second connecting wire, said second adjustable potentiometer is provided with an adjustable knob and pointer, wherein said second adjustable potentiometer is adapted to operate in communication with said electronic cycle timing device to control said visual display lifting apparatus deflation duration.

5. The message display device of claim 4, wherein said first adjustable potentiometer is set to a desired setting, whereupon current passes from said electronic cycle timing device to said air blower, wherein said air blower is actuated to supply pressurized air to said visual lifting apparatus through an air inlet port of a lower air bag, thus inflating said lower air bag, whereupon a medial air bag and an upper air bag are inflated over said prescribed time interval, thus applying a simultaneous upward force against an upper surface and a downward force against a lower surface, thereby causing an opening of said upper surface and facilitating elongated extension of said visual display in a taut manner, whereupon completion of said prescribed time interval as set by said first adjustable potentiometer, said visual lifting apparatus deflates, discharging air from said upper, lower, and medial air bags through said air hose to said air blower from which air escapes via an air vent of said air blower for a time period as prescribed by said second adjustable potentiometer, and a plurality of linear creases of said visual display thereby facilitating collapse of said plurality of air bags and said visual display in an accordion manner to a compact shape.

6. The message display device of claim 5, wherein said upper surface is a fabric layer adhered to a bottom surface of a vehicle hood, and wherein said lower surface is an automobile engine compartment.

7. The message display device of claim 4, wherein said potentiometric control unit is supplied with a cigarette lighter adapter to facilitate alternate electrical connection to said power source.

8. A message display device comprising:

a potentiometric control unit, said potentiometric control unit is electrically connected to an air blower via controlled connecting circuit, said potentiometric control unit is of a compact size allowing for placement within an engine compartment of a vehicle;

a power source, said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower; and a visual display, said visual display is removably attached to said visual display lifting apparatus via a fastening means, wherein said visual display lifting apparatus defines a plurality of inflatable air bags, wherein said plurality of inflatable air bags includes an upper air bag, a medial air bag, and a lower air bag, wherein each of said plurality of inflatable air bags is generally triangular-shaped in cross-section and has a lower surface and an upper surface joined by a convoluted circumferential sidewall, wherein said convoluted circumferential sidewall of each of said plurality of inflatable air bags forms recesses, said plurality of inflatable air bags is fabricated of a textile material defining a non-skid surface having small protuberances randomly dispersed, wherein said protuberances facilitate adhesive engagement to said upper surface and said lower surface, wherein an upper surface of said lower air bag is attached in an air-tight manner to a lower surface of said medial air bag, and an upper surface of said medial air bag is attached in an air-tight manner to a lower surface of said upper air bag, wherein said upper surface of said lower air bag and said lower surface of said medial air bag and said lower surface of said upper air bag define one or more air-flow portals to facilitate air communication between said plurality of inflatable air bags.

9. The message display device of claim 8, wherein said textile material is vinyl.

10. A message display device comprising:

a potentiometric control unit, said potentiometric control unit is electrically connected to an air blower via controlled connecting circuit, said potentiometric control unit is of a compact size allowing for placement within an engine compartment of a vehicle, a power source, said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower; and a visual display, said visual display is removably attached to said visual display lifting apparatus via a fastening means, wherein said fastening means includes integral strap-support loops being positioned along a left front corner and a right front corner of an upper air bag and along a left front corner and a right front corner of a lower air bag.

11. A message display device comprising:

a potentiometric control unit, said potentiometric control unit is electrically connected to an air blower via controlled connecting circuit, said potentiometric control unit is of a compact size allowing for placement within an engine compartment of a vehicle;

a power source, said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower; and a visual display, said visual display is removably attached to said visual display lifting apparatus via a fastening means, wherein said visual display defines a generally square-shaped sheet of collapsible material having an upper edge opposing a lower edge, said visual display is provided with a plurality of linear creases being horizontally aligned at spaced locations there down, said upper edge and said lower edge of said visual display are formed into an elongated loop which provides a passage through which a straightener member is slidably inserted, said straightener member is of a length measuring greater than a length of said elongated loop, thus upon insertion of said straightener member through said elongated loop, opposed ends of said straightener member protrude beyond ends of said elongated loop, wherein said opposed ends of said straightener member are looped with a fastening strap and wherein said fastening strap is inserted within said loops, whereupon each said fastening strap is subsequently tied, thereby facilitating attachment of said visual display to said visual display lifting apparatus.

12. A message display device comprising:

a potentiometric control unit, said potentiometric control unit is electrically connected to an air blower via controlled connecting circuit, said potentiometric control unit is of a compact size allowing for placement within an engine compartment of a vehicle;

a power source, said power source being electrically connected to and powering said potentiometric control unit;

an air hose, said air hose extends from said air blower;

a visual display lifting apparatus, said visual display lifting apparatus is connected to said air blower by said air hose, wherein said visual display lifting apparatus is in air communication with said air blower;

a retractable visual display, said retractable visual display comprises a generally rectangular housing, said housing includes an elongated slot located along a top side of and adjacent to a forward side wall of said housing so as to permit a flexible banner to pass through said elongated slot, said forward side wall is opposed by a rear side wall, wherein said housing includes a spring-biased mandrel, around which said flexible banner is wound and affixed at a lower end of said spring-biased mandrel, said spring-biased mandrel has an anterior end opposite a posterior end, and wherein said flexible banner is removably attached to said visual display lifting apparatus; and a lifting apparatus support base, said lifting apparatus support base is of an elongated configuration, wherein said retractable visual display is mounted atop a front portion of said lifting apparatus support base, wherein a remaining portion of said lifting apparatus support base provides a surface for accommodating said visual display lifting apparatus.

13. The message display device of claim 12, wherein said retractable visual display further comprises:

a header plate, said header plate has an integral cylindrical boss projecting outwardly therefrom so as to provide bearing support to said spring-biased mandrel, said header plate is mounted flush to an outer end of said housing against said forward side wall, said top side, and said rear side wall of said housing;

a torque-spring anchoring cap, said torque-spring anchoring cap is mounted against an inner wall of said header plate, a torque-spring anchoring cap is provided, said torque-spring anchoring cap has an internal elongated notch for anchoring a first end of a torque spring;

a cap ring, said cap ring is mounted flush against said torque-spring anchoring cap and said cap ring has a smaller diameter than said torque-spring anchoring cap, said cap ring defines a spring-arm passage extending downward therethrough and being aligned with said internal elongated notch of said torque-spring anchoring cap, said spring-arm passage provides a channel through which an arm of said torque spring passes and extends from said arm at said arm's first end to said internal elongated notch of said torque-spring anchoring cap;

a mandrel-abutment ring, said mandrel-abutment ring is formed integral to said spring-biased mandrel and extends radially around said spring-biased mandrel, wherein said mandrel-abutment ring functions to limit lateral movement of said spring-biased mandrel toward said header plate, said mandrel-abutment ring has a face which abuts against an outer face of said cap ring upon lateral movement of said spring-biased mandrel in a direction toward said cap ring, thus arresting further movement of said spring-biased mandrel, said spring-biased mandrel rotatably resides within a mandrel-receiving chamber located inside said housing, wherein said mandrel-receiving chamber is formed as a cylindrical cavity which extends through said cap ring, through said torque-spring anchoring cap, and through said header plate, wherein said anterior end of said spring-biased mandrel protrudes outside said header plate, said spring-biased mandrel is adapted to provide return torsional force via said torque spring being coiled around said spring-biased mandrel and down a length of said spring-biased mandrel, and wherein said torque spring is attached to said spring-biased mandrel at said anterior end and posterior end of said spring-biased mandrel, wherein said posterior end of said spring-biased mandrel is provided with an elongated slit extending axially through said spring-biased mandrel which allows anchored engagement by an elbow of said torque spring, thus securing said torque spring to said spring-biased mandrel;

an end cap plate, said end cap plate is mounted to said housing against said forward side wall, said top side, and said rear side wall of said housing, wherein said end cap plate is positioned opposed to said header plate;

a bearing cap, said bearing cap is mounted against an inner wall of said end cap plate;

a core end cap, said core end cap is mounted flush against and has a smaller diameter than said bearing cap;

a linearly elongated bore, said linearly elongated bore extends through said end cap plate, through said bearing cap, and through said core end cap, said linearly elongated bore provides a bearing surface for a bearing pin;

a second elongated slot, said second elongated slot extends axially through said anterior end of said spring-biased mandrel, said elongated slot is adapted to receive a flat working end of a standard flat-blade screwdriver, thereby facilitating manual torquing of said spring-biased mandrel; and a threaded thru-hole, said threaded thru-hole is formed within both said cylindrical boss of said header plate and said spring-biased mandrel, thereby facilitating locking of a desired torque of said spring-biased mandrel, wherein said header plate and said spring-biased mandrel are manually aligned and threadedly receive a threaded industrial pin.

14. The message display device of claim 12, wherein said flexible banner has an upper edge formed into an elongated loop, said elongated loop encases a straightener member, wherein said straightener member is of a length measuring greater than a length of said elongated slot of said housing, thereby preventing retraction of said straightener member into said housing, said straightener member has ends inserted through integral strap-support loops of said visual display lifting apparatus, thereby facilitating removable attachment of said flexible banner to said visual display lifting apparatus.

* * * * *